US006340261B1

(12) United States Patent
Furukawa

(10) Patent No.: US 6,340,261 B1
(45) Date of Patent: Jan. 22, 2002

(54) BALL-POINT PEN

(75) Inventor: Kazuhiko Furukawa, Kanagawa (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/530,821

(22) PCT Filed: Oct. 16, 1998

(86) PCT No.: PCT/JP98/04684

§ 371 Date: May 26, 2000

§ 102(e) Date: May 26, 2000

(87) PCT Pub. No.: WO99/24266

PCT Pub. Date: May 20, 1999

(30) Foreign Application Priority Data

Nov. 6, 1997 (JP) ..... 9-319175

(51) Int. Cl.[7] ..... B43K 7/10

(52) U.S. Cl. ..... 401/216; 401/106; 401/110; 401/214

(58) Field of Search ..... 401/104–106, 401/109–112, 209, 214–216, 219

(56) References Cited

U.S. PATENT DOCUMENTS 5,277,510 A * 1/1994 Okamoto et al. ..... 401/214
5,871,296 A * 2/1999 Furukawa et al. ..... 401/106

FOREIGN PATENT DOCUMENTS

| | | |
|---|---|---|
| JP | 08267985 | 10/1996 |
| JP | 08267986 A | 10/1996 |
| JP | 09118095 | 5/1997 |
| JP | 09118096 | 5/1997 |
| JP | 09175083 | 7/1997 |

* cited by examiner

*Primary Examiner*—David J. Walczak
*Assistant Examiner*—Peter deVore
(74) *Attorney, Agent, or Firm*—Darby & Darby

(57) ABSTRACT

A ball-point pen is so configured that an elastic body is installed in a state that it cannot be pulled out such that it can push a ball at the point at all times directly or indirectly via a movable member, satisfying a relation $20 \cdot W < P < 75 \cdot W$ between a projection area W ($mm^2$) of a diameter of a writing ball and a pushing force P (g) of an elastic body. Moreover, the effect can be increased by restricting a return load and materials.

6 Claims, 5 Drawing Sheets

BALL-POINT PEN

TECHNICAL FIELD

The present invention relates to an improvement of a ball-point pen having a ball valve mechanism at the point, by pushing a writing ball at the pen point with an elastic body at all times, wherein a ball serving as a writing portion is prevented from slipping out and fitted loosely, in the state having a space of a proper size to ensure a channel of the ink. More specifically, the present invention relates to an improvement relating to solve drawbacks such as a play of the ball, writing characteristics, shock resistance, vibration starving or the like of ball-point pen with an oil-based or water-based ink or a clicking-type ball-point pen, having a medium viscosity ink.

BACKGROUND ART

Conventionally, as a ball-point pen type writing instrument, there can be mentioned: a so-called oil-based ball-point pen with an ink having a high viscosity (about 10,000 cp), using a higher alcohol solvent as a main solvent, is directly contained in an ink container tube; a so-called water-based ball-point pen with an ink having a low viscosity (from 2 to 3 cp), using water as a main solvent is stored in a bundle of fibers, referred to as slivers; and a neutral ball-point pen having intermediate properties of oil-based and water-based ball-point pens. Since the oil-based ball-point pen has a high viscosity, the manner that writing sensation is heavy, lots of blobbing is caused, and since the ink is directly stored, if air comes into the point, a trouble of back leaking of the ink is easily caused. On the other hand, the water-based ball-point pen has such disadvantages that the remaining amount of the ink cannot be confirmed, that the ink easily spreads out onto the face of a document, that since members such as slivers and intermediate feed do not discharge all the ink, the life span is short, and that barrel cylinder becomes thick. With the neutral ball-point pen for solving these drawbacks, back leaking can be almost resolved by means of a mechanism of prevention of back leaking, such as a ball valve. The present applicant has already proposed an invention of a neutral ball-point pen of a type in which a writing ball is pushed with a small load at all times toward inside of the pen point, but when adopting the invention for an actual writing instrument, drawbacks described below were found, and further improvement became necessary.

With a ball-point pen of a type in which the writing ball is pushed by an internal elastic body, there is a case where a ball seat and a point portion are worn away by the ball, with the progress of writing, and though the ink still remains, the ball slips out, thereby the ball-point pen cannot be used anymore for writing. In particular, in the case where a coloring agent of the ink is a pigment type ink with a solid fine powder being dispersed, or in the case where the ink is a water-based ink using water having poor lubricity as a base, or in the case where the oil-based ink is an ink having a viscosity of a medium level (from 10 to 5000 cp at 25° C.), these drawbacks are easily caused, due to wear caused by the solid component, or because of discontinuity of the ink film which tends to occur during ball rotation. As measures against these, there has been considered a measure in which a material of the ball and a tip holder is changed to a material such as a stainless steel having a high hardness, but in that case, there are such disadvantages that machining of the tip holder becomes difficult in proportion to the hardness, and the pen point becomes expensive. Also, when an improvement is performed with an ink, if a lubricant is blended into the ink in a large amount, these disadvantages are alleviated. Due to the lubricant, however, the ink tends to cause spreading on the face of a document, and a drawback of forward leaking, that is, the surface tension of the ink decreases to make the pen point easy to be wet, and when the pen is turned downward, the ink leaks out from the pen point. Thus, it has been found that a simple improvement with an ink is also difficult.

Furthermore, for a ball-point pen using a volatile ink, an elastic body is provided for pushing the writing ball at all times in order to prevent an ink from being volatilized when the ball-point pen is not used for writing, or to prevent starving, or in the worst case, back leaking of the ink caused by the air caught up from the pen point due to an impact such as being dropped or the like, or a so-called forward leaking, that is, the ink is dripping from the pen point. When a pushing force was increased for improving the effect, the forward leaking preventing characteristics was improved, but internal wear and, in the worst case, slipping out of the ball were caused due to writing. In the case of a clicking-type ball-point pen, there is a further drawback that at the time of accommodating a writing element serving as a writing body, the writing element is accommodated with an impact to cause the ball much easier to slip out. Furthermore, when a diameter of the writing ball increases, it favors prevention of the wear, but starving becomes more easily caused due to an impact because of the air brought up from the tip, compared to the case of the writing ball with a small diameter. As a measure against these drawbacks, there is proposed a measure in which a rubber or a spring is inserted between the writing element and the inside of the barrel cylinder, for absorbing the impact. However, with this ball-point pen, there is caused a drawback in that the rubber or the like for absorbing the impact is deformed at the time of writing, causing the pen point to move back and forth, to thereby make writing difficult. Also, another drawback occurs in that since the number of parts increases and it is necessary to consider a method for fixation, the cost also increases.

In particular, with a so-called neutral ball-point pen using an ink having a viscosity intermediate between the oil-based ball-point pen and the water-based ball-point pen, the above-mentioned drawbacks are more likely to occur. However, though being rather insufficient as a ball-point pen, the neutral ball-point pen is put on the market, since other advantages thereof are recognized. Some invention of ball-point pens in which these drawbacks are solved have been proposed occasionally, however, it is still necessary to solve a drawback of wear within the pen point and a drawback of starving resulting from the low impact resistance, considering the productivity, the cost and correlation with the clicking mechanism, including a new demand arising from needs of bold or fine tips.

The present invention is directed to an improvement of a so-called ball-point pen type writing instrument, wherein a ball serving as a writing portion is fitted loosely to the inside a point assembly of popular type, in a state protruding from the point yet not to slip out, and more specifically, the present invention is directed to an improvement of a ball-point pen having an ink having a medium viscosity. A major object of the present invention is to solve a drawback that writing becomes impossible with the ink still remaining inside before the life span as a pen body is finished, while ensuring the writing sensation from the initial stage as writing proceeds. Moreover, another object of the present invention is to provide a writing instrument having excellent performance at a low cost, without requiring an ink of special blend or an advanced mechanism, by solving drawbacks such as starving due to a diameter of a writing ball, or starving and slipping out of the ball due to a return impact in the case of a clicking type ball-point pen, without sacrificing the productivity and performance of the ball-point pen.

DISCLOSURE OF THE INVENTION

The ball-point pen of the present invention devised to solve the above described drawbacks is so configured that a ball serving as a writing portion rotatably protrudes, at distal end while prevented from slipping out, and an ink is accommodated within an ink container tube. It is constructed such that the ink is led out onto a face of an outside document, from a ball which is rotatable and serving as a writing portion, through ink channels such as a plurality of channel grooves set to be a proper size within the pen point, a lateral play in the lateral direction, and a vertical play in which the ball can move so that the ink can be led in the vertical direction. The loosely fitted ball is prevented from slipping out by means of a front caulking by means of a plastic deformation and a rear ball seat, in the freely rotatable state. The ball is prevented from slipping out by means of a stable caulking by the optimization of the ball protrusion, the inner diameter and outer diameter of the caulking portion. As one example, at the time of caulking process, the inner diameter portion of the caulking portion is rather strongly caulked until abutting against the ball, to thereby form a seal face inside. In this case, if the seal face has a shape with approximately the same R as the ball, and a certain width over the whole periphery, the drawback of the forward leaking can further be solved. Moreover, while ensuring the vertical play, if a ball seat that becomes a rearward receiving face in the axial direction of the ball and has approximately the same R as the ball is provided, this becomes effective for solving the drawback of wear.

That is to say, a first gist of the present invention is a ball-point pen whose ball rotatably fitted loosely in the state of protruding outside from front end is restricted in its back and forth movement by a caulking portion at the front end and by a ball seat at rear end, comprising: a point assembly having an ink hole for leading the ink from the rear end side; an ink storing tube for directly storing a so-called medium viscosity ink whose ink viscosity at a normal temperature (23° C.) is in a range of from 10 cp to 5000 cp; a channel groove constituted by a plurality of grooves communicating the ball seat and the ink hole, which is not penetrated through in the longitudinal direction; and an elastic body installed in a state that it cannot be pulled out such that it pushes the ball at the point directly or indirectly via a movable member at all times; wherein the following relation:

$$20 \cdot W < P < 75 \cdot W$$

is satisfied between a projection area W ($mm^2$)) of a diameter of the writing ball and a pushing force P (g) of the elastic body.

A second gist of the present invention is a clicking-type ball-point pen according to the first gist, further comprising: a front opening from which a writing portion can be protruded at a front end of barrel cylinder, and a click bar serving as a protruding pushing portion at the rear end, and accommodating a writing element serving as a writing body within the bar, movably in the back and forth direction; wherein the writing element is constructed such that it is urged rearward at all times by a return spring; and that the following relation:

$$50 \cdot R < S < (50 \cdot R + 20 \cdot P)$$

is satisfied among a ball pushing force P (g) within the point assembly and a pushing force S (g) of the return spring and a weight R (g) of the writing element.

A third gist of the present invention is a clicking-type ball-point pen according to the first gist, further comprising: a so-called double clicking-type clicking mechanism wherein the writing body is protruded for writing by pushing the click bar, and the writing body can subsequently be retracted by pushing the click bar again, characterized in that a rotator abutting against the writing element or backside of the writing element moves while rotating, between a moving distance L of the writing element from a protruding state at the time of writing to a retracted state at the time of non-writing, to thereby convert a part of the impact due to a pushing force of the return spring at the time of retraction into a rotation movement of a predetermined angle θ, and the following relations are satisfied:

$$5\ \text{mm} < L < 10\ \text{mm, and } 40\ \text{degrees} < \theta < 160\ \text{degrees.}$$

A fourth gist of the present invention is a ball-point pen according to the first gist, further comprising: a so-called double clicking-type clicking mechanism wherein the writing body is protruded for writing by pushing the click bar, and the writing body can subsequently be retracted by pushing the click bar again, characterized in that a rotator abutting against the writing element or backside of the writing element moves while rotating, between a moving distance L of the writing element from a protruding state at the time of writing to a retracted state at the time of non-writing, to thereby convert a part of the impact due to a pushing force of the return spring at the time of retraction into a rotation movement of a predetermined angle θ, and the following relations are satisfied:

$$5\ \text{mm} < L < 10\ \text{mm, and } 40\ \text{degrees} < \theta < 160\ \text{degrees.}$$

A fifth gist of the present invention is a clicking-type ball-point pen according to the second gist, further comprising: a so-called safety mechanism comprising an elastic clip outside a barrel cylinder, having a latch portion for protruding the writing body enabling to write, automatically retracing the writing element serving as the writing body when the clip is lifted for putting the ball-point pen in clothes, characterized in that all parts, that are separated behind the writing element in the state of writing and are bumped on each other and affected by the impact at the time of return, are made of a synthetic resin such as rubber, elastomer, plastic or the like, and at least one of the parts is constructed by a material having an internal loss η, which is a vibration absorbing property, of not less than 0.02, and flexural modulus E that shows a rigidity of all the parts affected by the impact, of not less than 1,300 MPa.

A sixth gist of the present invention is a clicking-type ball-point pen according to the third gist, further comprising: a so-called safety mechanism comprising an elastic clip outside barrel cylinder, having a latch portion for protruding the writing body enabling to write automatically retracting the writing element serving as the writing body when the clip is lifted for putting the ball-point pen in clothes, characterized in that all parts, that are separated behind the writing element in the state of writing and are bumped on each other and affected by the impact at the time of return, are made of a synthetic resin such as rubber, elastomer, plastic or the like, and at least one of the parts is constructed by a material having an internal loss η, which is a vibration absorbing property, of not less than 0.02, and flexural modulus E that shows a rigidity of all the parts affected by the impact, of not less than 1,300 MPa.

A seventh gist of the present invention is a clicking-type ball-point pen according to the fourth gist, further comprising: a so-called safety mechanism comprising an elastic clip outside a barrel cylinder, having a latch portion for protruding the writing body enabling to write automatically retracting the writing elements serving as the writing body when the clip is lifted for putting the ball-point pen in clothes, characterized in that all parts, that are separated behind the writing element in the state of writing and are bumped on each other and affected by the impact at the time of return, are made of a synthetic resin such as rubber, elastomer, plastic or the like, and at least one of the parts is constructed by a material having an internal loss η, which is a vibration absorbing property, of not less than 0.02, and flexural modulus E that shows a rigidity of all the parts affected by the impact, of not less than 1,300 MPa.

As a first means for making the present invention effective as described above, an elastic body for urging the writing ball forward at all times is provided behind the writing ball, directly or indirectly via a piece movable between the elastic body and the writing ball, while the writing ball is prevented from slipping out by a caulking portion at front tip, thereby the elastic body is loosely fitted such that the forward of the elastic body cannot be pulled out by means of the writing ball, and the rear thereof cannot be pulled out by means of a caulking portion at the rear end of the point assembly and an internal step of a joint part at the rear of the point assembly. Here, the construction is such that the following relation:

$$20 \cdot W < P < 75 \cdot W$$

is satisfied between a projection sectional area W ($mm^2$)) of the writing ball and a pushing force P (g) of the elastic body. That is to say, since the ball diameter and the projection area have a relation of squares, it is constructed such that as the diameter of the writing ball increases, a pushing load of the elastic body increases in proportion to a square.

As a second means of the present invention, after the first means is satisfied, it is mounted in the clicking-type writing instrument, such that the writing element is urged backward at all times by a return spring, and the following relation:

$$50 \cdot R < S < (50 \cdot R + 20 \cdot P)$$

is satisfied among a writing element weight R, and a pushing force S of the return spring and a pushing force P of the elastic body within the point assembly.

As third and fourth means of the present invention, the mechanism of a clicking-type is a so-called double clicking type (or also referred to as kaan-type clicking), wherein protrusion and retraction at the point assembly from the inside of the barrel cylinder are repeated only by pushing with the clicking bar, and the rotation angle θ at the time of returning from the protruding state to the retracted state is set to be 40 degrees<θ<160 degrees, while defining the stroke moving distance L of the clicking (the length of a difference between a length in the protruding state from the point assembly and a length at the time of retraction) is to be 5 mm<L<10 mm, which is larger than the normal 4 mm.

Moreover, as means for alleviating the clicking impact at the time of return, all parts behind the writing element that are affected by the impact at the time of return are made of a synthetic resin such as rubber, elastomer, plastic or the like, and at least one of the parts is constructed by a material having an internal loss η, which is a vibration absorbing property, of not less than 0.02, and flexural modulus E that shows a rigidity of all the parts affected by the impact, of not less than 1,300 MPa. Specifically, a ball-point pen with a pigment type water-based ink having an ink viscosity of from 10 cp to 5000 cp at 23° C.±5° C., which is referred to as a neutral type, troubles such as back leaking and forward leaking are easily caused, thus a prevention mechanism is required, as well as wear becomes severe and furthermore it is necessary to ensure a large ink channel. In such cases, the effect of the present invention is especially anticipated.

The operation of the above-described will now be described. With the improvement achieved by the present invention, it becomes possible to prevent starving due to vibration, forward leaking and back leaking that are easily caused in a ball-point pen of a medium viscosity type, and to ensure high performance such as keeping balance among slipping out of the ball, starving at the time of strong impact and writing performance, which tends to cause a trouble in the case of a mechanism in which the writing ball is urged with a small force within the point assembly. The present invention provides a particularly effective operation for applied products such as for fine writing, for bold writing, for clicking-type and the like that are high in user's demand. By satisfying the relation of 20·W<P<75·W between a projection area W of a diameter of the ball and a pushing load P of the writing ball, no starving occurs due to vibrations, the writing performance is not deteriorated, which occurs when the ball becomes hard to rotate due to a too strong pushing force, and furthermore, slipping out of the ball due to being dropped or due to a clicking impact as well as a phenomenon that the pen tip wears due to writing does not occur. Moreover, in the case of a clicking type, there are drawbacks in that if the return pushing load S is too large, an impact force becomes big to cause a drawback such as starving or the like, or if the return pushing load S is too weak, the pen tip is clicked unintentionally due to vibration at the time of being carried or due to a light impact, to thereby cause the pen tip to protrude to stain clothes. When the pushing load S of the return spring is defined to be 50·R<S<(50·R+20·P) for alleviating or removing harmful effect of the return impact, the minimum return pushing load S is set by the weight R of the writing element and the maximum return pushing load S is set in proportion to the pushing load P of the writing ball within the point assembly described above, thereby a ball-point pen having no drawback can be obtained. That is to say, as weight of the writing element becomes heavier, larger return pushing load S is required, and as the pushing load P of the writing ball becomes longer, the impact resistance increases. Hence, the return pushing load S can be made large.

In the case of a double-clicking type ball-point pen, the moving amount of the writing element at the time of return acts not only on the vertical movement in the axial direction but also on the moving amount in the rotational direction utilizing a cam, and as a result, it has an effect as an impact reducing mechanism. With the present invention, when the moving amount L of the pen tip between protruding and retracting states is set to be a large stroke amount of from not smaller than 5 mm to more than 10 mm, by setting the rotation angle θ to be 40 degrees<θ<160 degrees, which is larger than the normal rotation angle, for the effective operation of reducing the impact, thereby the writing element is retracted while rotating largely at the time of return, to alleviate the impact effectively. If the rotation angle θ is not larger than 40 degrees, the movement of the writing element becomes close to a straight line to increase the impact value to the writing element, and if the rotation angle θ is 160 degrees or larger, the rotation angle by one click becomes too large, and a practical writing instrument cannot be obtained. If the parts behind the writing element are made to be impact-absorbing parts, more effective operation can be expected. In general, however, those having a large coefficient of internal loss η showing the degree of impact absorption are soft and do not have a rigidity in many cases, and one that is simply soft cannot satisfy the function expected from its shape, and there are drawbacks in that it is necessary to specially arrange those parts as impact-absorbing parts, and furthermore, those parts are deformed even by a load at the time of writing, and the pen tip moves back and forth unsteadily at the time of writing. With the present invention, if the rigidity is 1,300 MPa or larger, the pen tip does not move back and forth with a writing pressure, and if the value of the internal loss η is 0.02 or larger, the ball-point pen has also an impact absorbency. Therefore, by forming the parts behind the writing element with a synthetic resin having a rigidity and a certain degree of vibration absorbency, and by forming at least one part with a material having a high impact absorbency, an effect of alleviating the impact at the time of return can be expected.

By constituting the ball-point pen as described above, the assembling feasibility, cost and stability of parts can be simultaneously satisfied.

Specifically, with a neutral ball-point pen having a low ink viscosity compared to an oil-based ball-point pen, the present invention can operate most effectively. Troubles such as forward leaking, back leaking and wear due to a large flow rate of ink and a difficulty to impart lubricity can be solved, and degree of freedom can be provided to the design of the ink, and as a result, the general performance of the pen body can be improved.

BEST MODE FOR CARRYING OUT THE INVENTION

Figure 1:
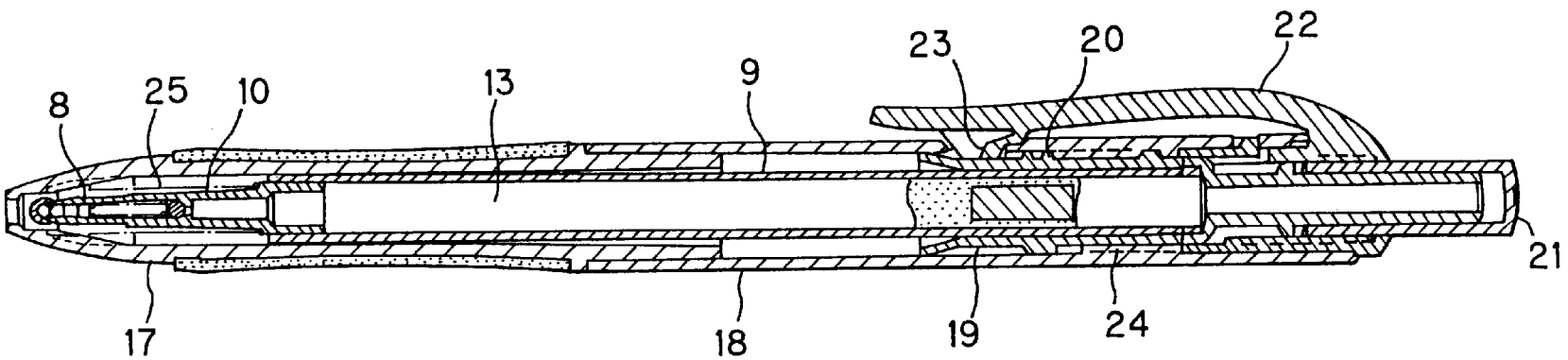
FIG. 1 is a longitudinal sectional view showing an overall structure when a ball-point pen is retracted, according to an embodiment of the present invention.
Figure 2:
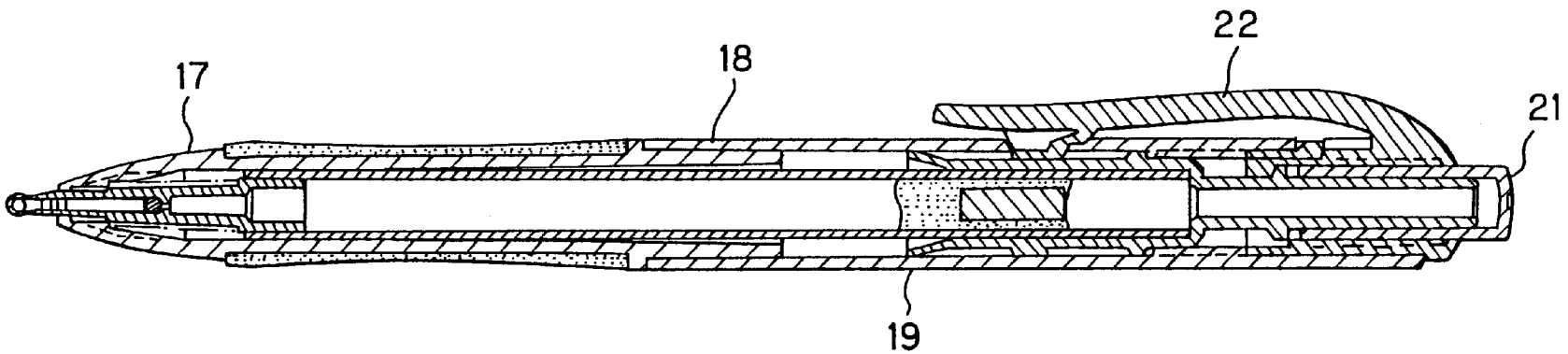
FIG. 2 is a longitudinal sectional view showing an overall structure when a tip of a ball-point pen is protruded, according to an embodiment of the present invention.
Figure 3:
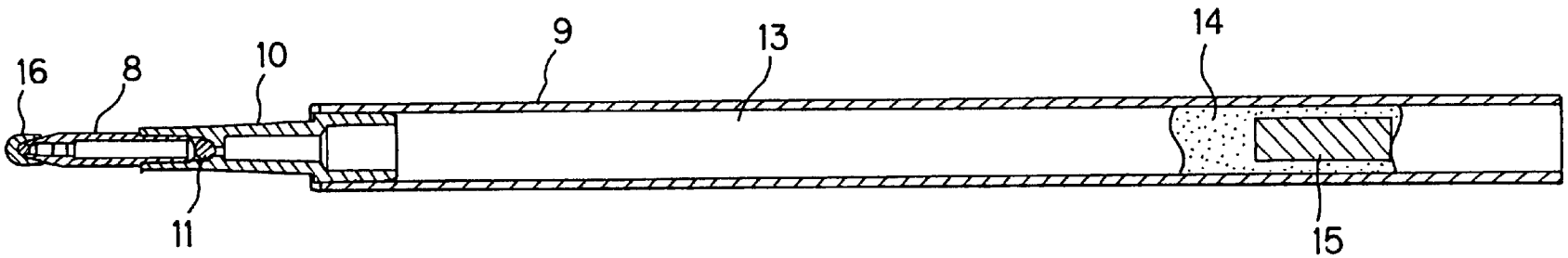
FIG. 3 is a longitudinal sectional view showing a writing element of a ball-point pen, according to an embodiment of the present invention.
Figure 4:
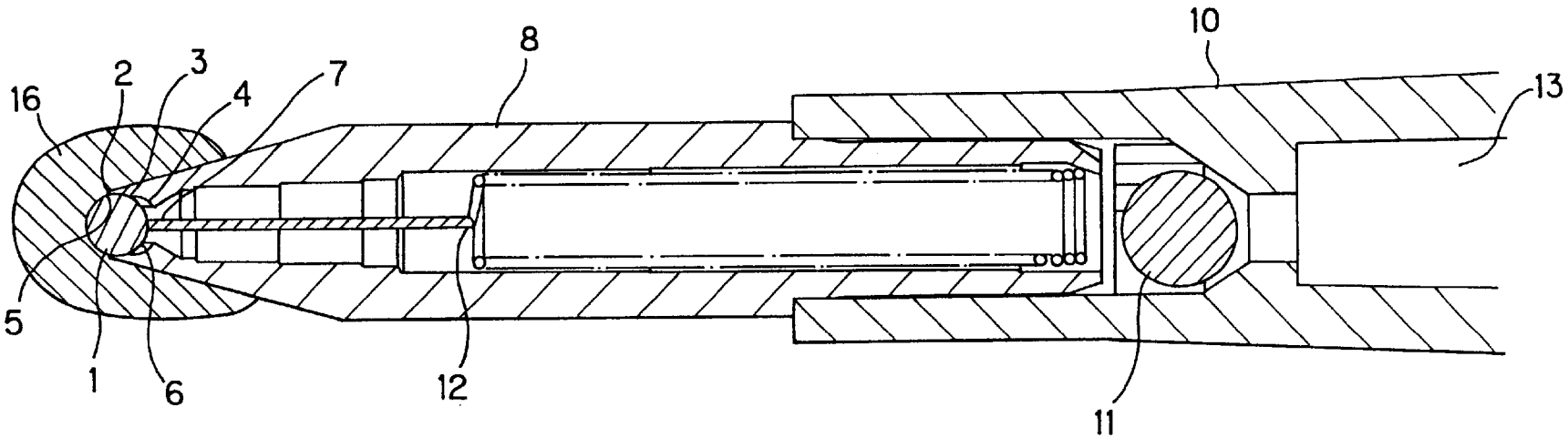
FIG. 4 is an enlarged longitudinal sectional view showing a structure on a point assembly of a ball-point pen according to an embodiment of the present invention.

FIGS. 1 to 5 show one example of a ball-point pen according to an embodiment of the present invention. A description is made hereinbelow with reference to the drawings.

At the point of a tip 8 made of a metal such as stainless steel, brass, German silver or the like, or a plastic, which serves as a point assembly of a ball-point pen, a writing ball 1 is prevented from slipping out by a caulking portion 2 at a front end and by a ball seat 6 at a rear end. The caulking portion 2 forms a seal face 5 for the writing ball 1. The writing ball 1 which is a sphere made of ceramics, cemented carbide, stainless steel or the like is loosely fitted rotatably within an internal wall 3, in the state having a longitudinal play back and front. The caulking portion is caulked at a caulking angle of from not less than 40 degrees to not more than 110 degrees (preferably from 50 degrees to 90 degrees), and in general, these caulking portions 2 are machined by plastic deformation or a combination of plastic deformation and cutting. The tip 8 is provided with a channel by means of an ink hole 7 from the rear part to the front end, and the tip 8 is adhered to an ink accommodating tube 9 at the rear or a joint 10 between the ink accommodating tube 9 and the tip.

Within the tip 8, there is provided a channel groove 4 constituted by a plurality of radial longitudinal grooves for ensuring an ink channel so that even if the ball 1 abuts against the ball seat 6 inside at the rear, the ink hole 7 is not blocked. An elastic body for urging the writing ball 1 forward at all times is provided behind the writing ball 1, directly or indirectly via a piece (not shown) movable between the elastic body 12 and the writing ball 1, thereby the elastic body 12 is loosely fitted such that the elastic body 12 cannot be removed neither forward, by means of the writing ball 1 prevented from being slipped out by the caulking portion 2, nor rearward, by means of the caulking portion at the rear end of the point assembly and an internal step of a joint part at the rear of the pen point assembly. Generally, as an operation of a back leaking prevention mechanism, the elastic body 12 is bent, with a writing pressure of about long at the time of writing, to move the ball 1 rearward within the point assembly to ensure the ink channel, while in a non-writing state, the ball 1 at the front end serves as a ball valve to block the ink channel to thereby prevent the back leaking of the ink 13. In addition to the above function, a function for preventing forward leaking, that is, when the pen is directed downward, the ink flows out from the pen point, can be obtained at the same time. Before the present invention was made, the pushing load of the elastic body 12 may be less than 80 g that is smaller than the writing pressure of 100 g of the pen and has been properly selected. However, when the ball diameter is small, and if a pushing load of the elastic body is set to be larger than a certain value, the ball slips out from the tip due to writing wear or an impact, that is, a so-called slipping out of the ball occurs. Moreover, in the case of a writing ball for bold letters having a large diameter, if the pushing load of the elastic body 12 is too small, the ball 1 at the point moves due to an impact applied at the time of carrying the pen body, to thereby release blocking by means of a valve, hence such a difficulty that air comes into from the point to cause starving occurs. As a result of investigation made by the present inventor, it was found that this difficulty could be solved by satisfying an expression of relations: $20 \cdot W < P < 75 \cdot W$ between a projection area W ($mm^2$)) of the writing ball 1 and a pushing force P (g) of the elastic body 12. In general, it is considered to be in proportion to the weight of the writing ball 1 and an impact value G. However, since the ball moves within the ink having a viscosity in a narrow space within the point assembly, it can be considered that the relation with resistance in the flow body is much more effective than the relation with the weight. For example, if it is assumed that there is a comparative relation between a ball with a diameter of 0.5, made of cemented carbide having a large specific gravity and having a weight of 0.00088 g and a ball with a diameter of 1.0 and having a weight of 0.007 g, the minimum pushing load P that does not cause vibration starving is about 5 g with a ball having a diameter of 0.5, and about 18 g with a ball having a diameter of 1.0, that is, the minimum pushing load P does not correlate with the weight ratio.

When mounted in the clicking-type writing instrument, the writing element is urged rearward at all times by means of the return spring 25, and at the time of being retracted, an impact caused by retracting the writing element is applied inside, hence if the return spring 25 is made strong, the writing ball 1 moves due to the impact to the ball valve by means of the elastic body 12 in the point assembly. If the return spring 25 is set to be too weak, there is caused such a difficulty that the pen tip protrudes due to poor operation or the impact at the time of carrying the pen, even without performing the clicking operation. It has been found that if a minimum pushing force S of the return spring 25 or a pushing force P of the elastic body 12 within the point assembly as described with reference to the first means is strong, depending upon the weight R of the writing element, a pushing force S of the return spring can be made large, and that it is possible to solve the difficulties by satisfying an expression of relations: $50 \cdot R < S < (50 \cdot R + 20 \cdot P)$.

This clicking type writing instrument has a writing element having a writing portion at the tip, a return spring 25 for urging the writing element rearward, a rotator 19 abutting against the rear end face of the writing element, and a click bar 21 protruding from a shaft cylinder at the back of the rotator. The protruding state can be effected by pushing the click bar 21 to protrude the writing element from the front portion of the barrel cylinder, and at this time, a latch portion 23 for parts such as a clip 22 attached to the step portion within the barrel cylinder or to the barrel cylinder engages with a latch rib 20 of the rotator 19 within the barrel cylinder to maintain the protruding state. The rotator 19 between the click bar 21 and the writing element and the click bar 21 having a detent are properly fitted loosely so as to be linked with the writing element by the clicking operation, and in the rearward direction, they are restricted by a barrel cylinder or a receiving portion of the clip 21 so as to operate only in a predetermined clicking stroke.

Figure 5:
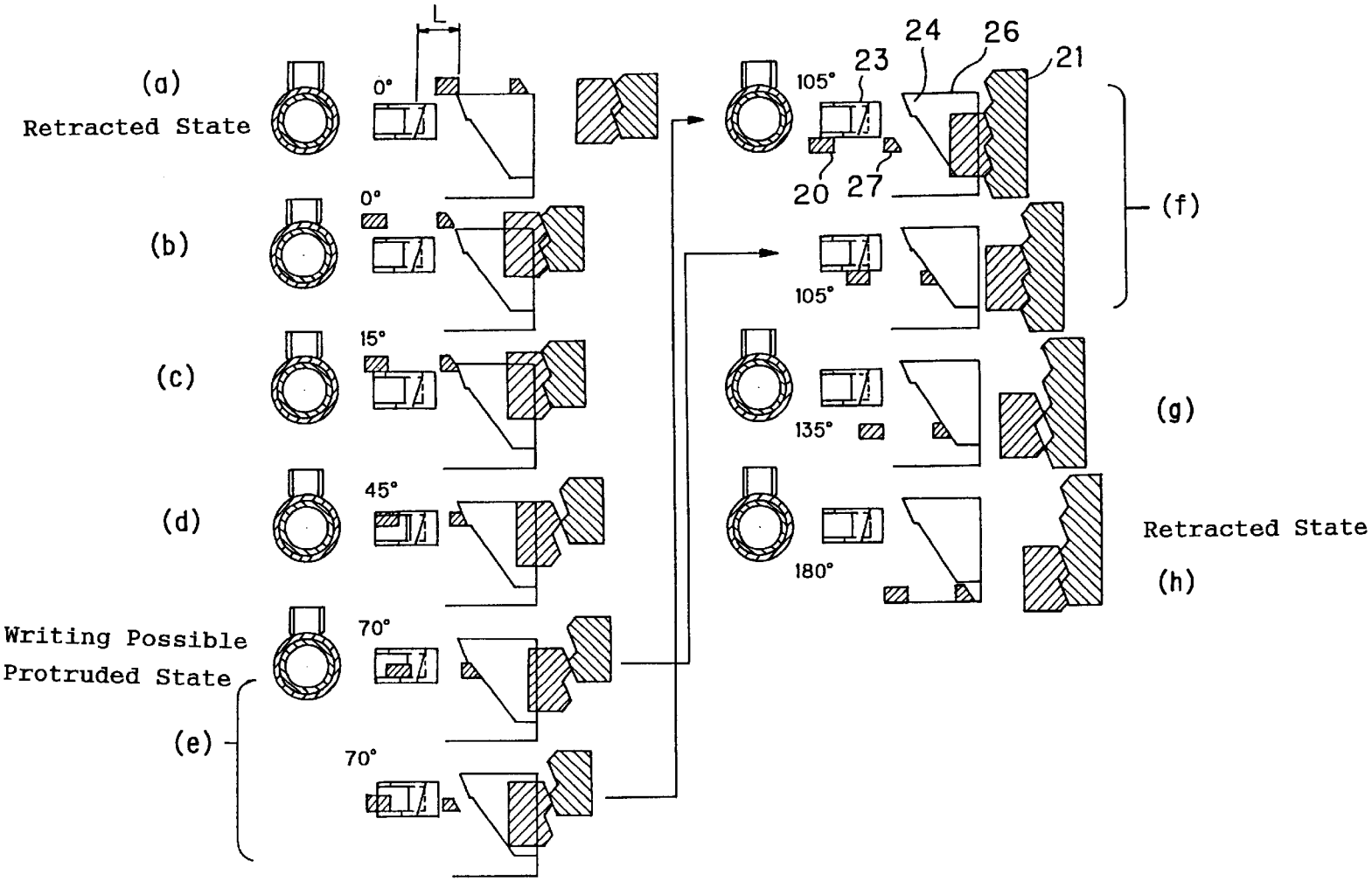
FIG. 5 is a schematic view showing an outline of a click-rotation mechanism (cam) of a ball-point pen according to an embodiment of the present invention.

When a so-called double clicking-type, wherein protrusion and retraction from/to the inside of the front barrel 17 of the point assembly are repeated only by pushing the click bar 21, is adopted as a clicking type mechanism, it has a structure such that the click bar 21 abuts against a finger while returning and the impact at the time of return is converted into a rotation force while returning, and as a result, the impact of the writing element can be weakened. When a clicking type is adopted for a ball-point pen of a medium viscosity type, in many cases, the stroke moving distance L of the clicking shown in FIG. 5 (a difference in length between a length in the protruding state of pen tip and a length at the time of retraction) is set to be about 4 mm or more, for preventing a phenomenon that when the end of the pen point is brought into contact with clothes, the ink begins to leak. However, if the moving distance L is 10 mm or more, the moving amount of the clicking increases and the ball-point pen is not convenient for use, and a return impact also increases. Therefore, to obtain an effective impact reducing mechanism, this length is defined to be $5\ \text{mm} < L < 10\ \text{mm}$, and a rotation angle $\theta$ at the time of return from the protruding state toward the retracted state is set large to be $40\ \text{degrees} < \theta < 160\ \text{degrees}$. Thereby, the impact can be further alleviated. In FIG. 5, the reference numeral 23 denotes a clip latch portion, 24 denotes a cam portion, 26 denotes a direct advance portion, and 27 denotes a cam protrusion, and in the example of FIG. 5, the rotation angle $\theta$=180 degrees (retracted state)−70 degrees (protruding state)=110 degrees.

Next is a description of operation of each portion depending upon the rotation angle of the rotator, with reference to FIG. 5. Following description is made based on each position of rotation angle of (a) to (h) in the figure.

(a) First, in the figure at a position of 0°, when the leftmost state is assumed to be a starting state, a cam face provided on the click bar 21 and a corresponding cam face of the rotator 19 are not in a state completely in accord with each other, but a protrusion 20 of the rotator 19 is prevented from rotating by a direct advance portion 26 provided integrally with a cam portion 24 of a rear barrel 18.

(b) Moreover, in the figure at a position of 0°, when the click bar 21 is pushed, the rotator 19 advances straight without rotating, until the cam protrusion 27 of the rotator 19 is disengaged from the direct advance portion 26.

(c) Next, in the figure at a position of 150, after the cam protrusion 27 is disengaged from the front end of the direct advance portion 26, the cam face of the click bar 21 and the cam face of the rotator 19 are in accord with each other, and the rotator is rotated by only 15°. At this time, the cam protrusion 27 rests on a slope of the cam portion 24 of the rear barrel 18. In this state, the pen tip protrudes from the end of the front barrel 17, and even if the click bar 21 is pushed further, no change in the movement occurs.

(d) Next, in the figure at a position of 45°, if pushing by the click bar 21 is stopped by releasing a hand, the rotator 19 starts to move backward together with the writing element by means of a force of the return spring 25, but since the cam protrusin 27 of the rotator 19 moves on the slope of the cam portion 24 of the rear barrel 18, the rotator 19 moves backward while rotating.

(e) Next, in the figure at a position of 70°, the latch protrusion 20 and the cam protrusion 27 are integrally provided in the rotator 19, and when the clip latch portion 23 of the clip 22 catches the latch protrusion 20 to come into a latched state, a state in which the rotation of the rotator 19 and the movement in the backward direction of the axis are stopped is maintained. At this time, the pen tip is protruded from the front barrel 17 by a predetermined quantity, that is, the pen tip is in a state of capable of writing.

(f)–(h) In order to retract the pen point, either the click bar 21 is pushed, or the clip 22 has only to be lifted to thereby release the latch of the clip. As shown in the figure, (f) shows a state at 105°, (g) shows a state at 135°, and (h) shows a state at 180°. Between these states, as described above, the cam protrusion 27 of the rotator 19 moves backward, while rotating on the slope of the cam portion 24 of the rear shaft 17. At this time, the writing element is in the retracted state. After 180°, since a combination of the cam having the same construction as this is provided on the opposite side, the changes from 180° to 360° are the same, and finally, it becomes the state of 360°=0°, enabling to repeat the protruding state and the retracted state of the pen tip only by pushing the click bar 21 repeatedly.

Furthermore, if it is tried to insert the ball-point pen into a pocket in the protruding state, the latch is released to become the retracted state, that is, a so-called safety mechanism is satisfied. That is to say, if it is tried to insert the ball-point pen into a pocket in the protruding state, the ink begins to leak to thereby stain clothes. To prevent this, a so-called safety mechanism is provided wherein when it is tried to insert the pen into clothes, the pen tip is automatically retracted. Thus, this type of ball-point pen becomes a further safe writing instrument. Specifically, the above-described safety effect can be exerted by having such a construction that the protruding state of the writing element maintained by latching of the latch portion 23 provided on the front barrel side of the clip 22 having an elasticity, which protrudes outside of the rear barrel 18 and the latch protrusion 20 provided in the rear barrel 18 or in parts within the rear barrel 18.

All parts rearward of the writing element that are affected by an impact at the time of return are made of a synthetic resin such as rubber, elastomer, plastic or the like, and at least one of the parts is constructed by a material having an internal loss A, which is a vibration absorbing property, of not less than 0.02, and flexural modulus E that shows a rigidity of all the parts affected by the impact, of not less than 1,300 MPa. Polyacetal, polyethylene (medium and high grades), general polypropylenes, liquid crystal polymers and the like are in accord with the present invention.

Even aluminum that is a relatively soft metal has an internal loss $\eta$ of 0.0005 or less, and scarcely has vibration absorbency. As a specific example, in an example of the present invention wherein the click bar is made of a liquid crystal polymer (Vectra A950 manufactured by Polyplastics Co., Ltd., $\eta$=about 0.06, elasticity=8,000 MPa) or an impact-resistant polyacetal (Delrin 500T manufactured by Du Pont, $\eta$=about 0.02 or higher, elasticity=1,900 MPa), compared to a Comparative Example wherein the click bar and the clip parts in which the internal step becomes a receiving face of the click bar 21 at the time of return are made of polybutylene terephthalate ($\eta$=0.01, elasticity=2,000 MPa), a significant difference in the vibration absorbency of about 30% could be seen in an evaluation of the starving property due to clicking of ball-point pens. Compared to a case wherein rubber ($\eta$=about 0.2, elasticity=900 MPa)is inserted in a part of the click bar that becomes a bumping portion, or a case wherein the click bar is made of a soft polyethylene ($\eta$=0.03, elasticity=1,100 MPa), the vibration absorbency showed a performance of about 50% or more, but there was no rigidity, and such troubles occurred that it was felt as if the pen tip is retreated at the time of writing, that functions of detent of the click bar could not be satisfied, that the compression rigidity was weak and the pen was plastically deformed, and that an extra part had to be specially attached to thereby make the barrel diameter big and increase the cost.

(Cited reference: Liquid Crystal Polymer "Vectra" catalog, published by Polyplastics Co., Ltd.)

According to the present invention, adverse effects to the writing element side can be reduced, by absorbing vibration at the time of receiving an impact, and a difficulty that the pen tip moves back and forth at the time of writing, caused when a soft rubber having no rigidity is used as in a conventional case can be solved by using a part having a certain rigidity. Moreover, since the part itself in the basic construction has vibration absorbency, there is no factor of increasing the cost, such as addition of parts or the like.

In a combination with a back leaking prevention mechanism, there is known one having a spherical back leaking prevention ball 11 or a nonspherical piece having a tapered face at one end, with a valve chamber being provided within the joint 10, but it is not limited by a combination with the present invention, and can expect its effect.

The ink 13 actually used has a viscosity of from 10 cp to 5000 cp at 23° C.±5° C., under a normal shear force, and contains water as a base, 5 to 50% of a low volatile solvent such as glycerin, propylene glycol or the like, 1 to 20% of a pigment or dye as a coloring agent, and proper various additives such as a dispersing agent, a gelling agent, an antiseptic agent, a surfactant, a lubricant or the like. Moreover, in a back portion of the ink 13, a follower 14 in a form of a very low volatile grease and a follower rod 15 in a form of a cup that is in a solid form and has a light specific gravity or a light apparent specific gravity are set afloat. Here, the ink 13 may be various inks such as a water-based type containing water as a base, an oil-based type containing a very low volatile higher alcohol as a base, an alcohol type containing a lower alcohol as a base, and a correction liquid type containing a volatile solvent such as methylcyclohexane or the like as a base, having a medium viscosity of from 10 cp to 5,000 cp.

When a hot-melt type tip sealing compound 16 that is melted at 80° C. to 120° C. are adhered at the point for protecting the pen tip, preventing volatilization and preventing air from being drawn in during transportation, long-life span can be anticipated and troubles due to transportation to the users can be prevented.

Evaluation examples of products based on the example of the present invention are presented below. The evaluation is based on a three-stage evaluation of ○X Δ, and ○ shows: No problem, Δ shows: There is some tendencies, nevertheless may be used, and X shows: Cannot be used. Products used for the evaluation are clicking-type medium viscosity ball-point pens (UMN-152) put on the market by Mitsubishi Pencil Co., Ltd., and standard parts are used except for modification in order to compare with the present invention.

As for the ball diameter of the pen tip, a prototype point assembly having the ball diameter of from 0.5 to 1.0 were used.

The writing ball pushing load P within the pen tip was set to be a predetermined load, by changing the whole length or the wire diameter of the elastic body (coil spring) of the point assembly.

The weight of writing element was evaluated by using a current product: 2.6 g as a standard; of which is the whole tube portion is made of a stainless steel: 5 g; and one added by a tail plug made of a metal pipe: 3 g.

The strength of the return spring was set such that the whole length and wire diameter of the coil spring was modified to be a predetermined load.

The following four evaluation items were compared and evaluated under the same conditions, with the number of samples n=5:

1) Initial writing properties: (write sensation, fast writing property, starving, and ink density are normal or not);
2) Vibration starving with an impact at the time of clicking return (degree of starving at the time of circular writing test after an impact);
3) Writing wear: (amount of wear of the pen tip after writing machine test to the end of the ink, and whether or not there is a slipping out of the ball);
4) Clicking operability: (if it is a reliable operation, whether or not there is any problem due to vibration at the time of carrying the pen).

Table 1 shows the contents of Examples 1 to 7 and Comparative Examples 1 to 5, and Table 2 shows the evaluation results and respective calculation values.

TABLE 1

| | Ball diameter ϕ (mm) | Projection area W ($mm^2$) | Pushing load P (g) | Weight of writing element R (g) | Return spring Minimum pushing load S (g) |
|---|---|---|---|---|---|
| Example 1 | 0.5 | 0.196 | 5 | 2.6 | 220 |
| Example 2 | 0.5 | 0.196 | 14 | 2.6 | 270 |
| Example 3 | 1.0 | 0.785 | 18 | 2.6 | 350 |
| Example 4 | 1.0 | 0.785 | 55 | 2.6 | 1000 |
| Example 5 | 0.7 | 0.385 | 25 | 5.0 | 270 |
| Example 6 | 0.7 | 0.385 | 13 | 5.0 | 250 |
| Example 7 | 0.6 | 0.823 | 15 | 3.0 | 250 |
| Co. Ex. 1 | 0.5 | 0.196 | 3 | 2.6 | 200 |
| Co. Ex. 2 | 0.5 | 0.196 | 3 | 2.6 | 100 |
| Co. Ex. 3 | 0.5 | 0.196 | 20 | 2.6 | 200 |
| Co. Ex. 4 | 1.0 | 0.785 | 13 | 5.0 | 350 |
| Co. Ex. 5 | 1.0 | 0.785 | 30 | 5.0 | 800 |

TABLE 2

| | Writing properites | Vibration starving property | Wear | Operability | 20–75 Calculation value A P = A × W | more than 50 Calculation value B S = B × R | less than 20 Calculation value C S = 50 × R + C × P |
|---|---|---|---|---|---|---|---|
| Example 1 | ○ | ○~Δ | ○ | ○ | 25.5 | 84.6 | 18.0 |
| Example 2 | ○ | ○ | ○~Δ | ○ | 71.3 | 103.8 | 19.3 |
| Example 3 | ○ | ○ | ○ | ○ | 22.9 | 134.6 | 19.4 |
| Example 4 | Δ | Δ | Δ | ○ | 70.0 | 384.6 | 18.2 |
| Example 5 | ○~Δ | ○ | ○~Δ | ○~Δ | 65.0 | 54.0 | 10.8 |
| Example 6 | ○ | Δ | ○ | Δ | 33.8 | 50.0 | 19.2 |
| Example 7 | ○~Δ | ○ | ○ | ○ | 53.1 | 83.3 | 16.7 |
| Co. Ex. 1 | ○ | x | ○ | ○~Δ | 15.3 | 76.9 | 66.7 |
| Co. Ex. 2 | ○ | Δ~x | x | x | 15.3 | 38.5 | 33.3 |
| Co. Ex. 3 | x | ○ | x | ○~Δ | 101.9 | 76.9 | 10.0 |
| Co. Ex. 4 | ○ | x | ○ | ○ | 16.6 | 70.0 | 26.9 |
| Co. Ex. 5 | ○ | Δ~x | ○ | ○ | 38.2 | 160.0 | 26.7 |

Industrial Applicability

If the present invention is applied, it becomes possible to provide easily assembled writing instruments and ball-point pens having features such as fine letter, bold letter or the like desired by users stably at a low cost, as well as having effects of the manner in which a writing instrument performs good writing sensation, and of solving drawbacks such as forward leaking and back leaking. Hence, it becomes possible to solve drawbacks with respect to the wear resistance such as starving, slipping out of the ball and the like, without adopting a high level ink or a complicated barrel mechanism. In particular, in the case of a clicking type ball-point pen, a drawback of starving at the time of return impact can be easily solved.

With a structure that a spring is built in the point assembly to push the writing ball forward at all times, to thereby bring the ball into close contact with the internal seal face of the present invention, almost all disadvantages for conventional so-called neutral ball-point pens using an ink having a medium viscosity can be solved. With one having changing ink viscosity due to a shear force, referred to as pseudoplasticity, during storage, the ink has a relatively high viscosity, and during writing, the viscosity of the ink decreases due to a shear force of the ball, hence a big effect can be expected by using it together with the point asssembly and mechanism of the present invention. Furthermore, when the present invention is applied for a ball-point pen having a large ball diameter, similar effect can be obtained. When the present invention is used with a back leaking prevention mechanism such as a ball valve mechanism or the like, writing instruments being free from back leaking even under a severe condition against the back leaking, such as writing in upright posture, can be provided.

What is claimed is:

1. A clicking-type ball-point pen having a front opening from which a writing portion can be protruded at a front end of a barrel cylinder, and a click bar serving as a protruding pushing portion at a rear end, whose ball rotatably fitted loosely in the state of protruding outside from the front end is restricted in the back and forth movement by a caulking portion at a front end and by a ball seat at a rear end, comprising:

a point assembly having an ink hole for leading the ink from the rear end side;

an ink storing tube for directly storing a medium viscosity ink whose ink viscosity at a normal temperature (23° C.) is in a range of from 10 cp to 5000 cp;

a channel groove constituted by a plurality of grooves communicating the ball seat and the ink hole, which is not penetrated through in the longitudinal direction; and an elastic body installed in a state that it cannot be pulled out such that it pushes the ball at the point directly or indirectly via a movable member at all times; and accommodating a writing element serving as a writing body within the barrel cylinder, movably in the back and forth direction;

wherein the following relation:

$$20 \cdot W < P < 75 \cdot W$$

is satisfied between a projection area W ($mm^2$) of a diameter of the writing ball and a pushing force P (g) of the elastic body; and wherein the writing element is constructed such that it is urged rearward at all times by a return spring; and the following relation:

$$50 \cdot R < S < (50 \cdot R + 20 \cdot P)$$

is satisfied among a ball pushing force P (g) within the point assembly and a pushing force S (g) of the return spring and a weight R (g) of the writing element.

2. A clicking-type ball-point pen according to claim 1, further comprising: a double clicking-type clicking mechanism wherein the writing body is protruded for writing by pushing the click bar, and the writing body can subsequently be retracted by pushing the click bar again, characterized in that a rotator abutting against the writing element or back-side of the writing element moves while rotating, during[]a moving distance L of the writing element from a protruding state at the time of writing to a retracted state at the time of non-writing, to thereby convert a part of the impact due to a pushing force of the return spring at the time of retraction into a rotation movement of a predetermined angle θ, and the following relations are satisfied:

$$5\ \text{mm} < L < 10\ \text{mm}, \text{ and } 40\ \text{degrees} < \theta < 160\ \text{degrees}.$$

3. A clicking-type ball-point pen according to claim 2 further comprising:

a safety mechanism comprising an elastic clip outside barrel cylinder, having a latch portion for protruding the writing body enabling to write automatically retracting the writing element serving as the writing body when the clip is lifted for putting the ball-point pen in clothes, characterized in that all parts that are separated behind the writing element in the state of writing, and are bumped on each other and affected by the impact at the time of return are made of a synthetic resin, and at least one of the parts is constructed by a material having an internal loss η, which is a vibration absorbing property, of not less than 0.02, and flexural modulus E that shows a rigidity of all the parts affected by the impact, of not less than 1,300 MPa.

4. A clicking-type ball-point pen according to claim 3, wherein the synthetic resin is selected from the group consisting of rubbers, elastomers, and plastics.

5. A clicking-type ball-point pen according to claim 1, further comprising:

a safety mechanism comprising an elastic clip outside barrel cylinder, having a latch portion for protruding the writing body enabling to write automatically retracting the writing element serving as the writing body when the clip is lifted for putting the ball-point pen in clothes, characterized in that all parts that are separated behind the writing element in the state of writing, and are bumped on each other and affected by the impact at the time of return are made of a synthetic resin, and at least one of the parts is constructed by a material having an internal loss η, which is a vibration absorbing property, of not less than 0.02, and flexural modulus E that shows a rigidity of all the parts affected by the impact, of not less than 1,300 MPa.

6. A clicking-type ball-point pen according to claim 5, wherein-the synthetic resin is selected from the group consisting of rubbers, elastomers, and plastics.

* * * * *